US006116069A

United States Patent [19]

Holliday

[11] Patent Number: 6,116,069

[45] Date of Patent: Sep. 12, 2000

[54] AXIAL DEFORMATION CRIMPING MACHINE FOR CABLE-TYPE END CONNECTORS

[75] Inventor: Randall A. Holliday, Westminster, Colo.

[73] Assignee: ICM Corporation, Denver, Colo.

[21] Appl. No.: 09/026,900

[22] Filed: Feb. 20, 1998

[51] Int. Cl.[7] ..... H01R 43/048

[52] U.S. Cl. ..... 72/21.6; 72/17.3; 72/316; 29/753; 29/237

[58] Field of Search ..... 72/316, 409.14, 72/409.13, 409.19, 17.3, 21.6; 29/753, 751, 237

[56] References Cited

U.S. PATENT DOCUMENTS

| | | | |
|---|---|---|---|
| 3,972,112 | 8/1976 | O'Sickey | 29/237 |
| 4,336,646 | 6/1982 | Feldman | 72/402 |
| 5,392,508 | 2/1995 | Holliday et al. | 29/751 |
| 5,435,167 | 7/1995 | Holliday | 72/409.14 |
| 5,501,616 | 3/1996 | Holliday | 439/585 |
| 5,596,800 | 1/1997 | Holliday | 72/409.14 |
| 5,647,119 | 7/1997 | Bourbeau | 72/409.14 |
| 5,743,131 | 4/1998 | Holliday | 72/409.13 |

FOREIGN PATENT DOCUMENTS

| | | | |
|---|---|---|---|
| 721953 | 11/1965 | Canada | 72/409.19 |

*Primary Examiner*—Daniel C. Crane
*Attorney, Agent, or Firm*—John E. Reilly

[57] ABSTRACT

An automated crimping machine for crimping a fitting or end connector onto an end of a cable is made up of segmental die portions which together form a die surface in the desired configuration including cylinder-operated pivot blocks to advance the segmental die portions between an open position and closed crimping position, a plunger assembly axially spaced from the die portions to support the fitting in loosely assembled relation on the cable and to automatically advance in an axial direction into the cavity formed by the die surfaces to cause the fitting to be crimped onto the cable end, following which the segmental die portions are expanded away from the fitting and the crimped fitting removed to permit insertion of the next fitting and cable which is advanced through a guide block into properly aligned relation with the plunger.

21 Claims, 3 Drawing Sheets

AXIAL DEFORMATION CRIMPING MACHINE FOR CABLE-TYPE END CONNECTORS

BACKGROUND AND FIELD OF INVENTION

This invention relates to crimping devices; and more particularly relates to a novel and improved automated crimping apparatus for compressing fittings into uniform sealed engagement with cables, such as, for instance, coaxial cables used in the cable television industry.

I have previously devised a hand-held crimping tool which is designed for use in the field of attaching a fitting onto the end of a coaxial cable. Specifically, the fitting is caused to undergo a uniform reduction in size or diameter by applying an axially directed force to the fitting, as opposed to direct radial compression, reference being made to U.S. Pat. No. 5,392,508 for AXIAL DEFORMATION CRIMPING TOOL. Moreover, the hand-held crimping tool and the principle of axial deformation have been found to be of particular utility in crimping end connectors of the type disclosed in my U.S. Pat. No. 5,501,616 for END CONNECTOR FOR COAXIAL CABLE. In particular, the crimping tool is extremely effective in causing the axially spaced endless sealing rings of the inner wall surface of the outer sleeve of the connector to undergo the desired reduction in diameter into uniform sealed engagement with the cable end.

Nevertheless, there is a need for a crimping machine which is automated and, in a closely coordinated sequence of steps, is capable of rapidly crimping a fitting or end connector onto a cable in a highly reliable and efficient manner. In this regard, the present invention is particularly adaptable for use in plant assembly operations wherein it is desirable to attach large quantities of fittings onto respective cable ends in a mass production type of operation.

SUMMARY OF THE INVENTION

It is therefore an object of the present invention to provide for a novel and improved crimping apparatus for compressing generally cylindrical sleeves into a conical configuration and specifically wherein each sleeve is subjected to an axially directed force in selectively reducing its diameter.

It is another object of the present invention to provide for a novel and improved automated crimping apparatus for crimping hollow cylindrical sleeve portions into sealed engagement with the end of a cable or other member in a minimum number of steps; and further wherein the apparatus requires minimum attention and control on the part of a human operator.

A further object of the present invention is to provide for automated crimping apparatus which is activated by insertion of a loosely assembled fitting on the end of a cable to automatically compress the fitting into uniform sealed engagement with the end of the cable in an accurate, dependable manner.

A still further object of the present invention is to provide for a novel and improved crimping apparatus which is compact and highly simplified in operation and is readily conformable for use in crimping different sized fittings onto cable ends.

In accordance with the present invention, automated crimping apparatus is provided for connecting a fitting having a generally tubular connector sleeve onto an end of a cable, the apparatus comprising a die member including a tapered cavity having a first diameter at a first end thereof substantially corresponding to an outer diameter of the sleeve and a second diameter axially spaced from the first diameter substantially corresponding to an outer diameter of the cable, carrier means axially spaced from the cavity for supporting the sleeve in spaced relation to the first end of the cavity with the cable extending through the cavity and at least partially inserted at one end into the sleeve, drive means associated with the carrier means for axially advancing the carrier means toward the die member in order to force the sleeve axially into the cavity under sufficient force to radially contract the sleeve into a tapered configuration conforming with the cavity thereby connecting the sleeve to the cable, and activating means for activating the drive means automatically in response to advancement of the fitting into engagement with an end of the carrier means.

The crimping apparatus of the present invention is further characterized by a die-shifting mechanism for advancing segmental die portions making up the cavity/die member between an open expanded position for axial insertion of the fitting and cable through the cavity into engagement with the carrier means and a closed position necessary for axial deformation of the sleeve. Preferably, the segmental die portions are in diametrically opposed relation to one another and the shifting means is operative to shift the die portions in a direction transversely of the movement of the carrier means.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
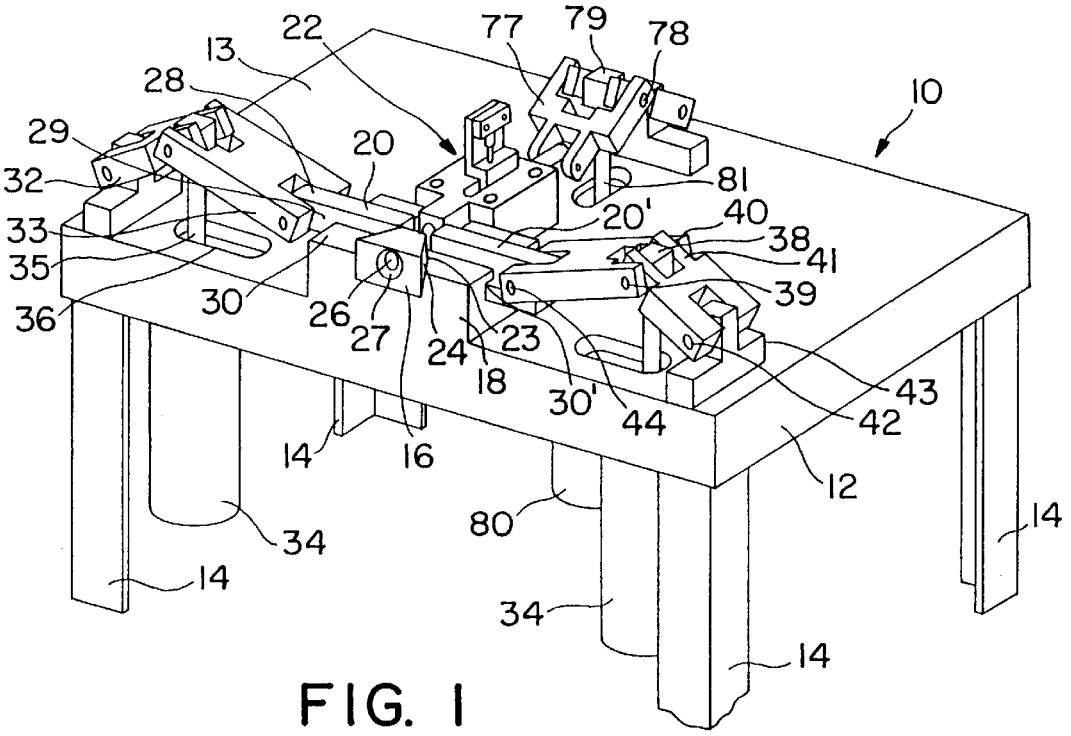
FIG. 1 is a perspective view of a preferred form of crimping machine in accordance with the present invention.

Referring in detail to the drawings, there is shown in FIGS. 1 to 7 a preferred form of crimping machine 10 which is broadly comprised of a generally rectangular table 12 with an upper work surface 13 and downwardly depending legs 14 at the four corners of the table 12. A guide block 16 is mounted on an upstanding mounting block 18 of the work surface 13 directly in front of a pair of diametrically opposed die blocks 20 and 20' and behind which is disposed a plunger assembly 22 which is axially aligned but in spaced relation to the guide block 16. As a setting for the present invention, the preferred form of crimping machine 10 is specifically adaptable for connecting a fitting F onto one end of a coaxial cable C to facilitate attachment of the cable C to the terminal or post on a television set. The fitting F includes a threaded end portion T and a hollow cylindrical connector sleeve S to be crimped onto the end of the cable C with a conductive element E from the cable C projecting beyond the threaded end portion T. It is to be understood, however, that the crimping machine 10 is conformable for use in other crimping operations as will become more readily apparent from the following description.

Figure 4:
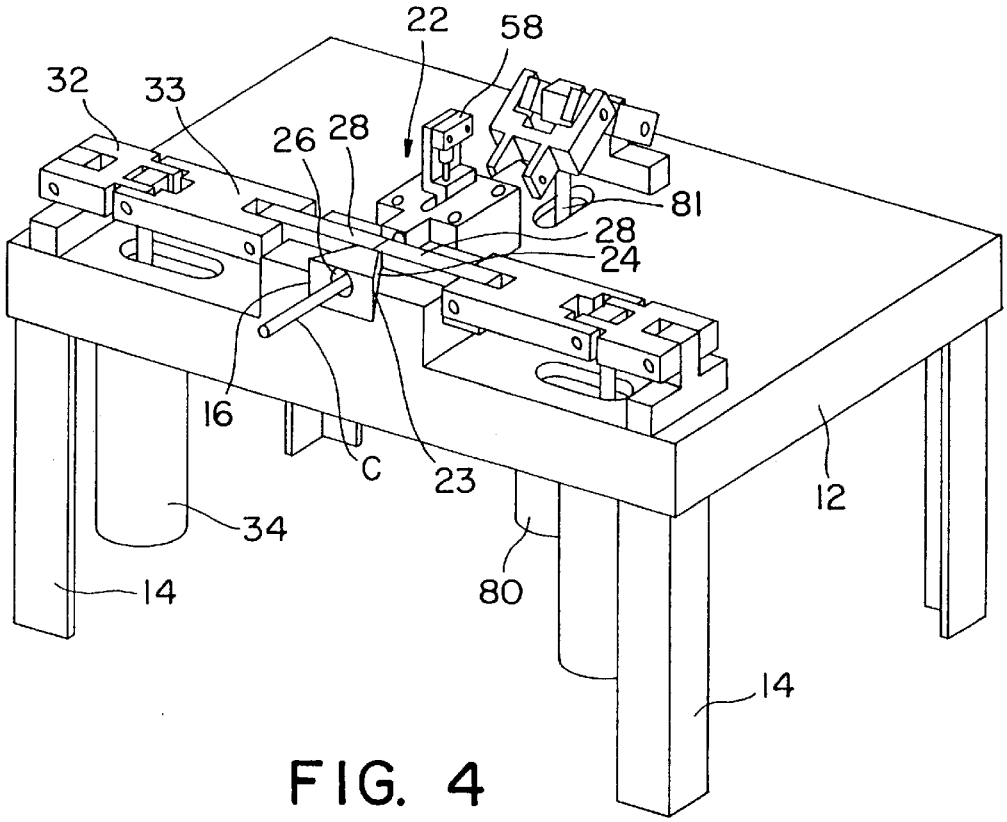
FIG. 4 is another perspective view of the preferred form of crimping machine with the die blocks illustrated in the crimping position and with the plunger assembly shown in the retracted position.
Figure 5:
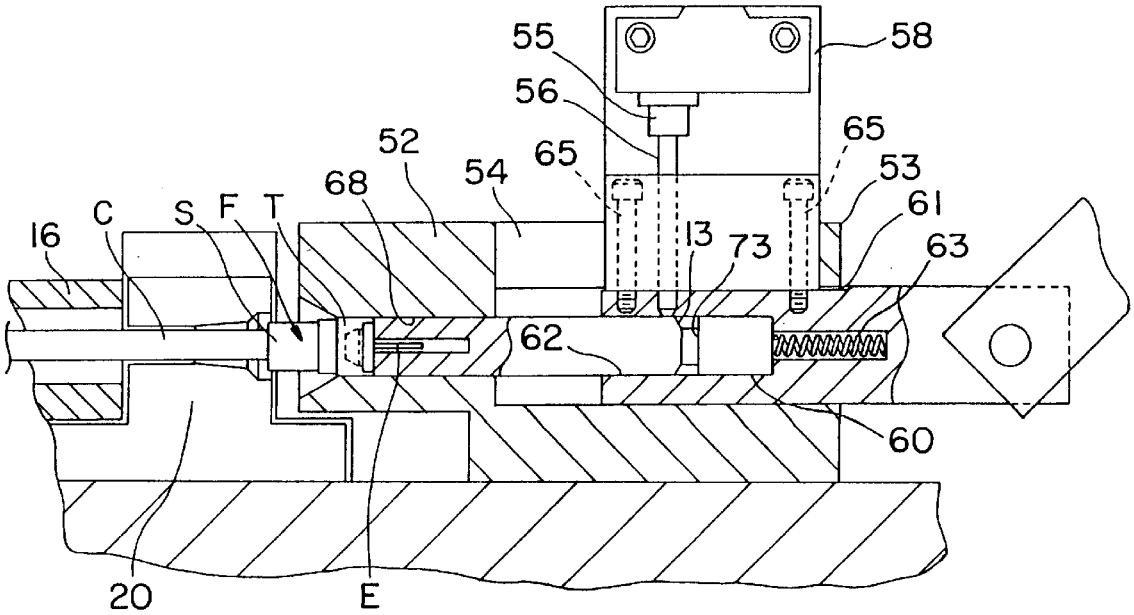
FIG. 5 is another view partially in section and enlarged illustrating an end connector and cable inserted into the crimping machine preliminary to the crimping operation when the plunger assembly is in the retracted position.
Figure 6:
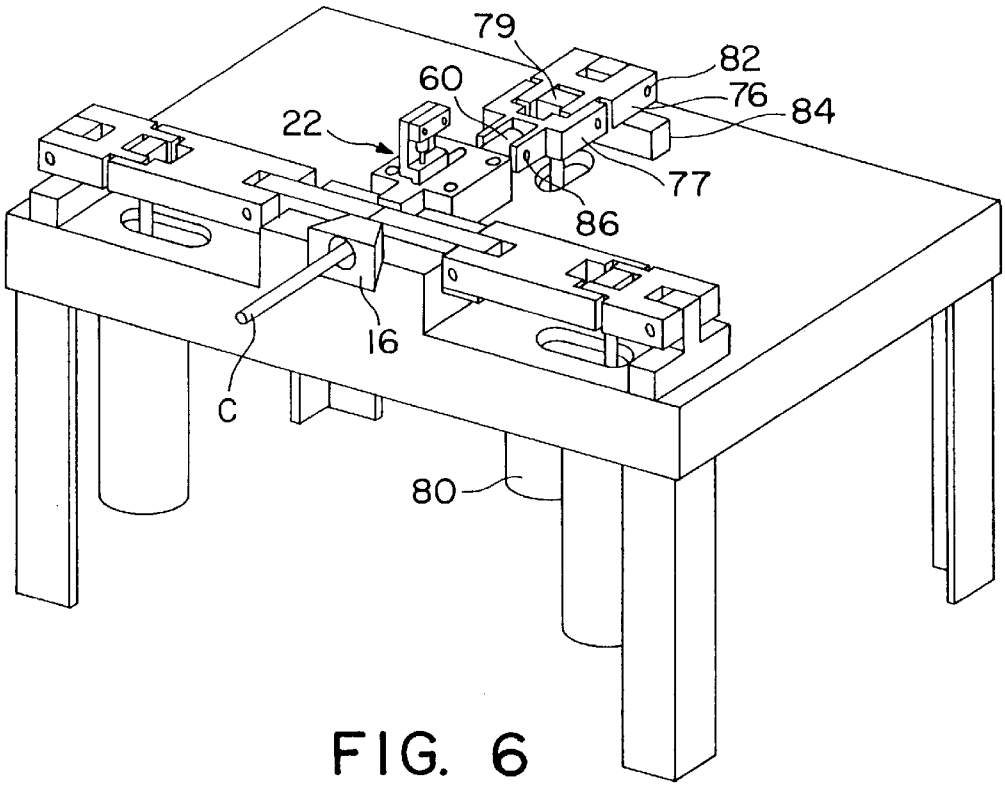
FIG. 6 is a perspective view of the preferred form of crimping machine illustrating the plunger assembly and die blocks in the advanced crimping position.

Preferably, the mounting block 18 is situated along and raised above a longitudinal edge of the table 12 with an upper dovetailed recess 23 to receive the guide block 16. The guide block 16 is provided with opposite tapered sides 24 complementary to the recess 23 and is anchored in the mounting block 18. A central bore 26 extends horizontally through the guide block 16 with a flared entrance 27, the bore 26 being sized to permit insertion therethrough of a fitting F loosely assembled onto the end of a cable C, for example, as illustrated in FIGS. 4 and 5.

As best seen from FIGS. 2, 3, 5, 6 and 7, each of the die blocks 20 and 20' is correspondingly made up of an elongated body 28 of generally rectangular cross-section having opposed side flanges 29 which slide in ways 30 and 30' in the mounting block 18 directly behind and slightly beneath the guide block 16, the ways 30 and 30' extending transversely to the path of advancement of the cable C through the guide block bore 26. Each of the die block bodies 28 is slidably controlled for movement through a respective way 30 and 30' by articulated clamp arms 32, 33 under the control of a pneumatic cylinder 34 suspended beneath the table 12 and having a rod 35 extending upwardly through an open slot 36 in the table 12. An upper terminal end 38 of the rod 35 receives pivot pin 39 extending through interleaved extensions 40 and 41 of the clamp arms 33 and 32, respectively, thereby pivotally interconnecting the arms 32 and 33 for movement between a raised, retracted position as shown in FIG. 1 and a flat advanced position as shown in FIG. 4. The outer end of each clamp arm 32, is pivotally attached by a pivot pin 42 to pivot block 43, and the opposite end of each clamp arm, 33 is pivotally attached by pin 44 to the end of each die block body 28.

Figure 3:
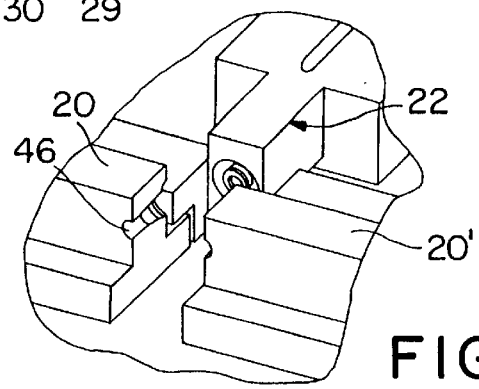
FIG. 3 is another somewhat fragmentary view of the die blocks and plunger assembly of the preferred form of crimping machine.

In order to define the axial deformation cavity, the confronting end surfaces of the die block bodies 28 are correspondingly formed with recessed die portions each including a straight semi-cylindrical section or recess 46 leading into a rearwardly divergent semi-conical surface 48, the latter terminating in a flared, rearward entrance 50. Briefly, when the clamp arms 32, 33 are in the retracted position as shown in FIG. 1, the die blocks 20 and 20' will be in the retracted position, as shown in FIGS. 1 and 3, so as to permit free advancement of a cable C through the guide block 16 toward the plunger assembly 22 to be described. When the cylinders 34 are activated to pivot the clamp arms 32, 33 to the flat or advanced position shown in FIG. 4, the die blocks 20, 20' are brought into abutting relation to one another so that the die portions are aligned with one another to form a full cylindrical section or cavity from the recesses 46 and a full conical section or tapered cavity from the conical recesses 48 as well as another tapered cavity in the form of an outwardly flared mouth or entrance 50.

In order to impart axial movement to the cable C and loosely assembled fitting F causing them to be forced forwardly into engagement with the mating die surfaces and particularly the conical sections 48, the plunger or carrier assembly 22 is axially aligned with the die portions or cavities as described and, in the preferred embodiment, not only serves as the force-applying member to drive the fitting F forwardly but also to trigger the entire crimping operation in an automated manner. Referring again to FIGS. 2, 4, 5 and 7, the carrier assembly 22 has an outer housing 52 mounted on the table 12 directly behind the transverse ways 30 and 30' for the die blocks 20 and 20'. The housing 52 includes a main body 53 provided with a vertical slot 54 through its upper wall for insertion of a plunger rod 56 aligned beneath a limit switch 55 on a support frame 58. A drive shaft 60 extends through a central bore 61 in the main body 53 and has a counterbore 62 with a spring return member 63 at its closed end. The support frame 58 is mounted by fasteners 65 to the shaft 60 to enable the plunger rod 56 to follow sliding movement of the shaft 60. A main carrier 66 in the form of an elongated plunger is slidable through the counterbore 62 and aligned counterbore 68 in the forward end of the housing 52, the carrier 66 having an external shoulder 69 and counterbore 70 at its forward end.

Axial sliding movement of the plunger housing 52 and plunger 66 is controlled by clamp arms 76 and 77 which are pivotally interconnected as at 78 along with the upper terminal end 79 of a pneumatic cylinder 80 having a rod 81 extending upwardly through a slot in the table 12. The opposite end of the clamp arm 76 is pivoted at 82 to pivot block 84, and the opposite end of the clamp arm 77 is pivoted as at 86 to the rearward end of the drive shaft 60. Normally, the plunger 66 is in the position shown in FIG. 2 with the lower end of the limit switch or plunger rod 56 extending through a radial bore 72 into a circumferential notch 73 in the carrier 66. When the cable C to be assembled is inserted through the guide block 16 into engagement with the plunger 66, as shown in FIG. 5, it will cause rearward movement of the plunger 66 against the bias of the return spring 63 to the retracted position illustrated in FIG. 5 whereupon the plunger rod 56 is forced upwardly out of the notch 73 along beveled surface 73' to trip the limit switch 55.

Figure 7:
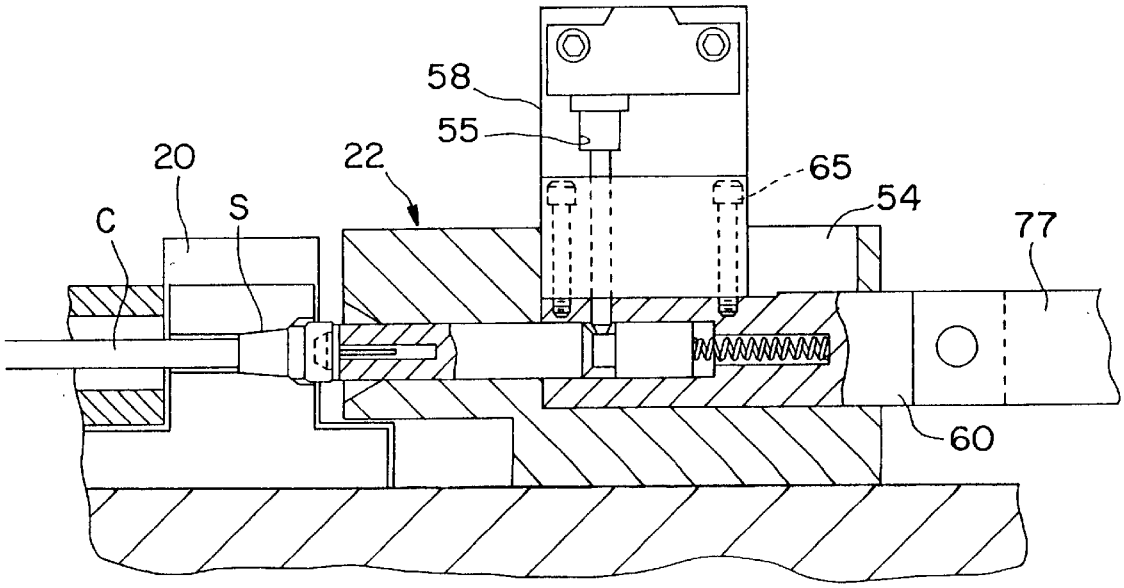
FIG. 7 is a somewhat fragmentary view showing the interrelationship between the die blocks and plunger assembly during the crimping operation.

In a closely coordinated sequence of steps, tripping of the limit switch 55 causes activation of the die block cylinders 34 to advance the die blocks to the closed position shown in FIG. 5, following which the plunger cylinder 80 is activated to advance the drive shaft 60 forwardly until the carrier 66 forces the fitting F axially into engagement with the conical sections 48 to crimp the sleeve S into a corresponding conical configuration as illustrated in FIG. 7, the limit switch 55 retaining the plunger rod 56 in a raised position out of the path of the carrier 66 until the end of the crimping cycle. The leading end of the fitting may undergo slight additional crimping to conform to the cylindrical configuration of the sections 46.

Figure 2:
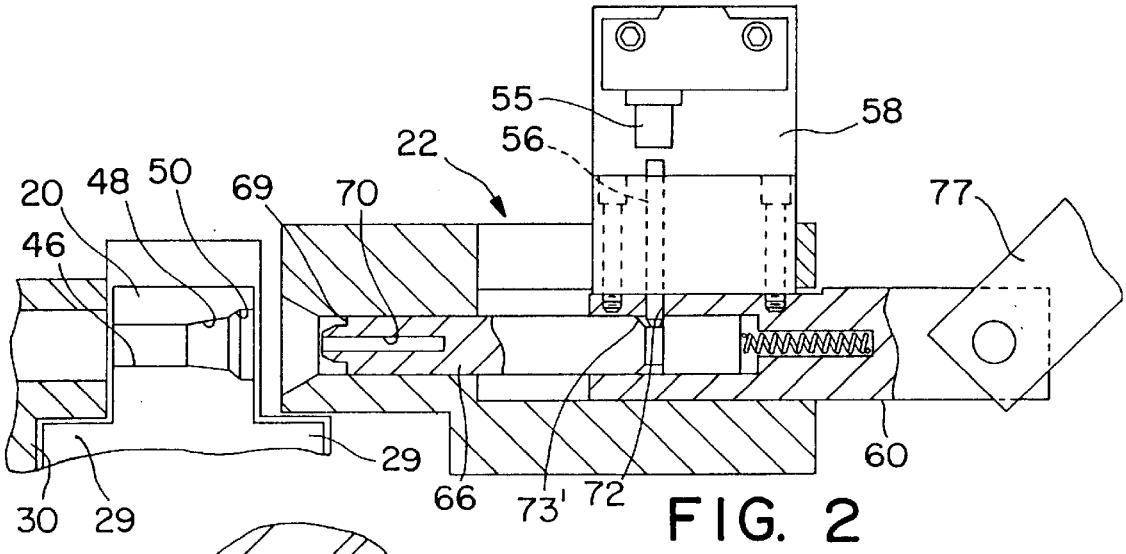
FIG. 2 is a somewhat fragmentary sectional view of a guide block, die blocks and plunger of the preferred form of crimping machine.

A suitable timer, not shown, will cause the cylinders 80 and 34 successively to be reversed in returning the plunger clamp arms 76, 77 to the retracted position shown in FIG. 1 and the guide block clamp arms 32 and 33 similarly to return to a retracted position whereupon the crimped fitting F and cable C are manually removed through the guide block 16. Simultaneously, the limit switch 55 is deactivated to permit the plunger rod 56 to return into the notch 73, as shown in FIG. 2, in preparation for the next cycle. Suitable proximity switches, not shown, may be employed to interrupt the crimping cycle in the event of jamming or misalignment.

It will be evident from the foregoing that the crimping cycle may be manually controlled, for example, to sequentially activate the die block cylinders 34 and plunger cylinder 80 to advance and return the die blocks 20, 20' and carrier 66. Furthermore, it will be apparent that the relative movement between the plunger 66 and die blocks 20–20' may be reversed so that, for example, once the cable C and fitting F are inserted and positioned on the end of the carrier 66, as shown in FIG. 5, the carrier 66 would remain stationary and the closed die blocks 20 and 20' advanced in an axial direction to cause axial deformation of the sleeve S into the conical configuration as shown in FIG. 7. The preferred form of machine is readily conformable for crimping different sized fittings simply by modifying the size of the recesses 48–50 on the die blocks 20, 21' as described; and correspondingly, the recesses may be varied and shaped to conform to different cross-sectional configurations of sleeves whether circular, oval, or polygonal shaped cross sections.

It is therefore to be understood that while preferred and modified forms of invention have been herein set forth and described, the above and other modifications and changes may be made in the construction and arrangement of parts as well as their operation without departing from the spirit and scope of the present invention as defined by the appended claims.

I claim:

1. Crimping apparatus for connecting a fitting having a connector sleeve in surrounding relation to an end of a cable, said apparatus comprising:

a fixed work surface and a guide member on said work surface provided with a guide passage for insertion of said fitting loosely assembled onto said cable therethrough;

a die member including a tapered cavity axially aligned with said guide passage having a first diameter at a first end thereof substantially corresponding to an outer diameter of said sleeve and a second diameter axially spaced from said first diameter substantially corresponding to an outer diameter of said cable;

carrier means aligned on a common axis with said cavity for supporting said sleeve in spaced relation to said first end of said cavity with said cable extending through said cavity and at least partially inserted at one end into said sleeve; and drive means associated with one of said die member and said carrier means for axially advancing said one of said die member and said carrier means with respect to the other whereby to force said sleeve axially into said cavity under sufficient force to radially contract said sleeve into a tapered configuration conforming to said tapered cavity thereby connecting said sleeve to said cable.

2. Apparatus according to claim 1 wherein said die member includes segmental die portions defining circumferential portions of said cavity, and die-shift means for shifting said die portions between an open expanded position for axial insertion of said fitting and said cable through said cavity into engagement with said carrier means and a closed position in closely surrounding relation to said fitting and said cable.

3. Apparatus according to claim 2 wherein there are a pair of said segmental die portions in diametrically opposed relation to one another, and said die-shift means is operative to shift said die portions in a direction transversely of said carrier means.

4. Apparatus according to claim 1 wherein said drive means is reversibly movable toward and away from said die member in response to being activated; and activating means for activating said drive means automatically in response to advancement of said fitting into engagement with an end of said carrier means.

5. Apparatus according to claim 1 wherein a guide member is provided at one end of said die member opposite to said carrier means to guide said cable and fitting through said die member into engagement with said carrier means.

6. Apparatus according to claim 1 wherein said carrier means includes an elongated, axially movable plunger at one end of a drive member, and said drive means being engageable with said drive member to axially avance said plunger toward said cavity.

7. Apparatus according to claim 6 wherein said plunger and drive members are disposed in a bore in a common housing, and a limit switch-activated plunger rod in the path of movement of said plunger member.

8. Apparatus according to claim 7 wherein a spring return is interposed between said plunger member and said drive member.

9. Apparatus according to claim 2 wherein said die shift means is defined by a pair of pivot blocks connected to an end of each of said die portions.

10. Apparatus according to claim 8 wherein a fluid cylinder is engageable with a common pivotal intersection between each said pair of said pivot blocks.

11. Apparatus according to claim 9 wherein said die portions are slidable in ways on a work surface for said apparatus.

12. A crimping machine for connecting a fitting having a generally tubular connector sleeve in surrounding relation to an end of a cable, said apparatus comprising:

a die member including a tapered cavity having a first diameter at a first end thereof substantially corresponding to an outer diameter of said sleeve and a second diameter axially spaced from said first diameter substantially corresponding to an outer diameter of said cable;

plunger means axially spaced from said cavity for supporting said sleeve in spaced facing relation to said first end of said cavity with said cable extending through said cavity and at least partially inserted at one end into said sleeve;

drive means associated with said plunger means for axially advancing said plunger means toward said cavity whereby to force said sleeve axially into said cavity under sufficient force to radially contract said sleeve into a tapered configuration conforming with said tapered cavity thereby connecting said sleeve to said cable; and activating means for activating said drive means automatically in response to advancement of said fitting into engagement with an end of said plunger means.

13. A machine according to claim 12 wherein said die member includes segmental die portions defining circumferential portions of said cavity, and die-shift means for shifting said die portions between an open expanded position for axial insertion of said fitting in said cable through said cavity into engagement with said plunger means and a closed position in closely surrounding relation to said fitting in said cable.

14. A machine according to claim 13 wherein there are a pair of said segmental die portions in diametrically opposed relation to one another, and said dieshift means is operative to shift said die portions in a direction transversely to said plunger means.

15. A machine according to claim 12 wherein said drive means is reversibly movable toward and away from said die member in response to being activated.

16. A machine according to claim 12 wherein a guide member is provided at one end of said die member opposite to said plunger means to guide said cable and fitting through said die member into engagement with said plunger means.

17. A crimping machine for automatically connecting a fitting onto an end of a coaxial cable wherein said fitting has a generally tubular sleeve in surrounding relation to an end of said cable, said machine comprising:

a die member including a tapered cavity having a first diameter at a first end thereof substantially corresponding to an outer diameter of said sleeve and a second diameter axially spaced from said first diameter substantially corresponding to an outer diameter of said cable;

a plunger assembly including a plunger member mounted coaxially with respect to said cavity and slidable toward and away from said cavity, each said fitting to be crimped having said cable extending through said cavity with said sleeve loosely assembled onto said end of said cable;

plunger drive means for axially advancing said plunger member toward said cavity under sufficient force to cause said sleeve to be forced into said cavity and radially contracted into close-fitting, crimped engagement with said cable; and activating means for activating said drive means in response to advancing said fitting and said cable through said cavity.

18. A machine according to claim 17 wherein said activating means includes limit switch means for activating said drive means automatically in response to advancement of said fitting through said cavity into engagement with an end of said plunger member.

19. A machine according to claim 17 wherein said die member includes segmental die portions defining circumferential portions of said cavity, die-shift means for shifting said die portions between an open expanded position for axial insertion of said fitting and said cable through said cavity and a closed position in closely surrounding relation to said fitting, and said activating means being operative to sequentially activate said die-shift means to advance from said open expanded position to said closed position followed by activating said drive means to advance said plunger member towards said cavity.

20. A machine according to claim 19 wherein said die-shift means for each of said die portions includes a fluid cylinder engageable with a common pivotal intersection between a pair of articulated clamp arms.

21. A machine according to claim 20 wherein said die portions are slidable in ways on a work surface for said apparatus.

* * * * *

UNITED STATES PATENT AND TRADEMARK OFFICE

CERTIFICATE OF CORRECTION

PATENT NO. : 6,116,069
DATED : September 12, 2000
INVENTOR(S) : Randall A. Holliday It is certified that error appears in the above-identified patent and that said Letters Patent is hereby corrected as shown below:

Column 3,
Line 44, cancel "opposite" and substitute -- inner --

Column 5,
Line 12, cancel "48-50" and substitute -- 48, 50 --
Line 12, cancel "20, 21" and substitute -- 20, 20' --

Signed and Sealed this

Fourth Day of December, 2001

*Attest:*

Nicholas P. Godici

NICHOLAS P. GODICI
*Acting Director of the United States Patent and Trademark Office*

*Attesting Officer*